US006845550B2

(12) United States Patent
Kimura et al.

(10) Patent No.: US 6,845,550 B2
(45) Date of Patent: Jan. 25, 2005

(54) WEAVING SYSTEM FOR WOVEN FABRICS OF VARIOUS KINDS IN SMALL LOTS

(75) Inventors: Hidetoshi Kimura, Kyoto (JP); Naotaka Sakamoto, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 142 days.

(21) Appl. No.: 10/375,264

(22) Filed: Feb. 28, 2003

(65) Prior Publication Data

US 2003/0196303 A1 Oct. 23, 2003

(30) Foreign Application Priority Data

Mar. 8, 2002 (JP) ..... 2002-063156

(51) Int. Cl.[7] ..... D02H 5/00
(52) U.S. Cl. ..... 28/184; 28/190
(58) Field of Search ..... 28/184, 190, 191, 28/192, 193, 202, 172.1, 201, 194–196, 208, 209, 214, 215; 139/317, 35, 97

(56) References Cited

U.S. PATENT DOCUMENTS

| | | | | | |
|---|---|---|---|---|---|
| 2,126,634 | A | * | 8/1938 | Homan | 28/184 |
| 2,299,587 | A | * | 10/1942 | Penman et al. | 28/184 |
| 2,578,017 | A | * | 12/1951 | Rovas | 28/190 |
| 3,153,274 | A | * | 10/1964 | Townsend | 28/159 |
| 3,587,146 | A | * | 6/1971 | Van Luyk et al. | 28/184 |
| 3,681,824 | A | * | 8/1972 | Yasuji | 28/180 |
| 4,259,994 | A | * | 4/1981 | Hobson | 139/1 R |
| 4,438,553 | A | * | 3/1984 | Hamada | 28/184 |
| 4,683,625 | A | * | 8/1987 | Baltzer | 28/191 |
| 5,630,262 | A | * | 5/1997 | Tanaka | 28/184 |
| 5,950,289 | A | * | 9/1999 | Tanaka | 28/190 |
| 6,427,299 | B2 | * | 8/2002 | Tanaka et al. | 28/190 |

FOREIGN PATENT DOCUMENTS

| | | |
|---|---|---|
| DE | 100 29 492 A | 1/2002 |
| EP | 0 989 218 A1 | 3/2000 |
| JP | 11-222744 | 8/1999 |

* cited by examiner

*Primary Examiner*—A. Vanatta
(74) *Attorney, Agent, or Firm*—Westerman, Hattori, Daniels & Adrian, LLP

(57) ABSTRACT

The present invention provides a weaving system for woven fabrics of various kinds in small lots, capable of weaving woven fabrics of various kinds in small lots in a continuous operation by an existing weaving machine while preventing generation of waste to the minimum degree. A weaving system for woven fabrics of various kinds in small lots, comprises the steps of successively selecting a plurality of kinds of threads according to a preliminarily designed design pattern, producing a thread supplying package for the warp by jointing per a predetermined thread supply amount, warping a plurality of the thread supplying packages for the warp so as to provide a warp beam, and organizing a weft to the warp supplied from the warp beam for forming different design patterns of a plurality of kinds continuously each with a warp thread jointing area disposed therebetween in the weaving direction.

5 Claims, 8 Drawing Sheets

In the embodiments hereafter:

n = 3 (color threads $Y_A$, $Y_B$, $Y_C$)

Embodiment N = 500

Packages $P_1 \sim P_{500}$

Fig.6

EFFECTS IN THE WARPING, SIZING STEP (PACKAGE DYING)

IN THE CASE OF PRODUCING FABRICS WITH PATTERNS OF DIFFERENT COLORS OR A WHITE GROUND AS SHOWN BELOW EACH BY 30m

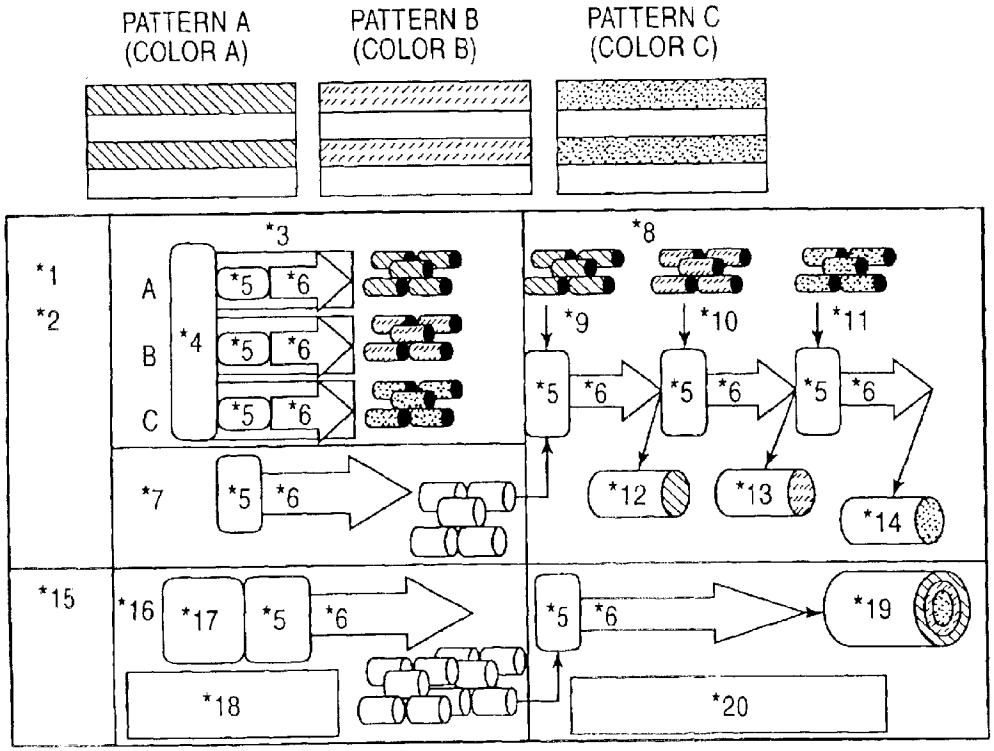

*1 CONVENTIONAL METHOD
*2 BEAMS OF 500 THREADS ARE PRODUCED FOR EACH COLOR, AND BEAMS OF 5,000 THREADS ARE PRODUCED CORRESPONDING TO THE GROUND IN THE SIZING STEP
*3 WARPING STEP
*4 SUBDIVISION
*5 PREPARATION
*6 OPERATION
*7 GROUND
*8 SIZING STEP
*9 COLOR A MIXING
*10 REPLACEMENT BY COLOR B
*11 REPLACEMENT BY COLOR C
*12 PATTERN A
*13 PATTERN B
*14 PATTERN C
*15 NOVEL METHOD
*16 COLOR A, B, C, GROUND
*17 PACKAGE PRODUCTION BY A NOVEL APPARATUS
*18 WARPING MACHINE WORKING RATIO IMPROVEMENT THREAD SUPPLY AND NUMBER OF BEAM REPLACEMENT CUT OFF NUMBER OF BEAMS CUT OFF
*19 PATTERN A, B, C
*20 SIZER WORKING RATIO IMPROVEMENT (BOILER ENERGY REDUCTION)

Fig.7

EFFECTS IN THE WARPING, SIZING STEP (BEAM DYING)

IN THE CASE OF PRODUCING FABRICS WITH PATTERNS OF DIFFERENT COLORS OR A WHITE GROUND AS SHOWN BELOW EACH BY 30m

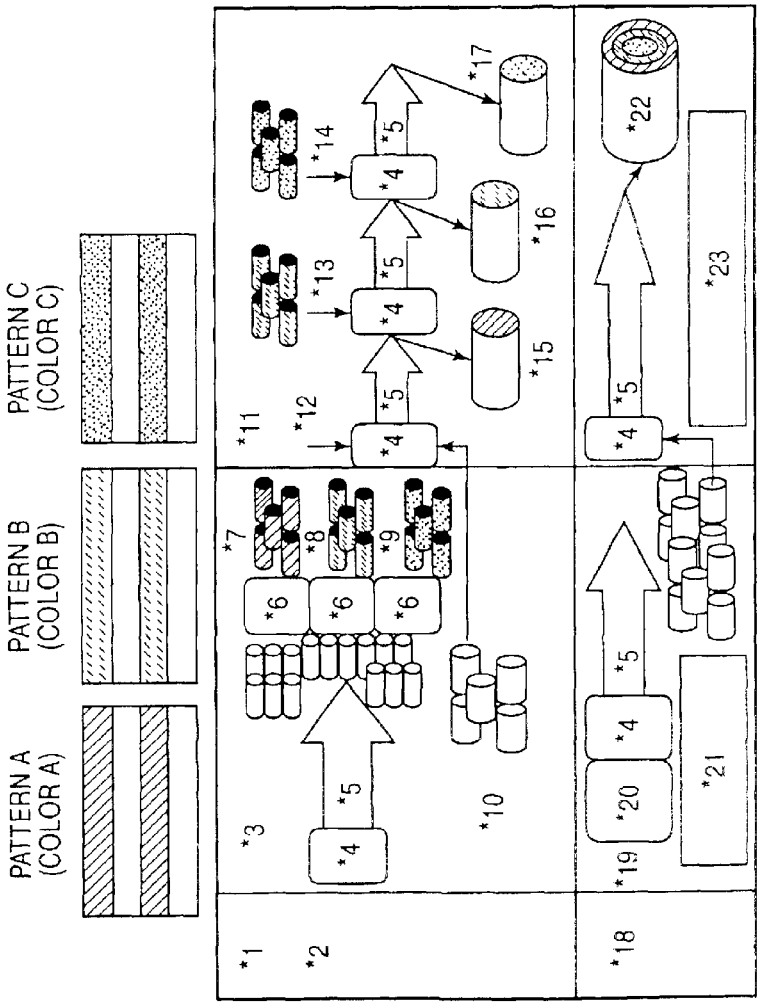

*1 CONVENTIONAL METHOD
*2 BEAMS OF 500 THREADS ARE PRODUCED FOR EACH COLOR, REQUIRED PARTS ARE DYED, AND BEAMS OF 5,000 THREADS ARE PRODUCED CORRESPONDING TO THE GROUND IN THE SIZING STEP
*3 WARPING STEP
*4 PREPARATION
*5 OPERATION
*6 DYING
*7 COLOR A
*8 COLOR B
*9 COLOR C
*10 GROUND
*11 SIZING
*12 COLOR A MIXING
*13 REPLACEMENT BY COLOR B
*14 REPLACEMENT BY COLOR C
*15 PATTERN A
*16 PATTERN B
*17 PATTERN C
*18 NOVEL METHOD
*19 COLOR A, B, C, GROUND
*20 PACKAGE PRODUCTION BY A NOVEL APPARATUS
*21 WARPING MACHINE WORKING RATIO IMPROVEMENT THREAD SUPPLY AND NUMBER OF BEAM REPLACEMENT CUT OFF NUMBER OF BEAMS CUT OFF
*22 PATTERN A, B, C
*23 SIZER WORKING RATIO IMPROVEMENT (BOILER ENERGY REDUCTION)

Effects in the weaving step

WEAVING SYSTEM FOR WOVEN FABRICS OF VARIOUS KINDS IN SMALL LOTS

BACKGROUND OF THE INVENTION

1. Field of the Invention

The present invention relates to a weaving system for woven fabrics of various kinds in small lots, capable of weaving woven fabrics of various kinds in small lots in a continuous operation by an existing weaving machine while preventing generation of waste to the minimum degree according to the trend of producing various kinds of woven fabric products in small lots.

2. Description of the Related Art

As it is already known, recently, in Japan, Europe, or the like, the weaving process has been shifted from large lots to small lots. However, according to the conventional weaving process, the waste is increased according to increase of the number of the kinds. In the present situation, for example, when an order of fabrics is sent from an apparel manufacturer to a weaving processing manufacturer, the form of ordering various kinds in small lots as preliminary samples of several kinds of each 3 m, and of several hundred meters after one or two months is common. However, according to the present weaving processing system, various problems are involved at the time of producing the fabrics by the various kinds in small lots as mentioned above.

Concerning the above-mentioned problems, what has conventionally been pointed out is that various warps are needed according to the increase of the kinds of the merchandises so that the number of preparatory steps of a warper, the number of steps of joining the warps in sizing (starching), the number of joining the warps in weaving, or the like are increased proportionally to the number of the kinds. Since the weaving machines are stopped in each operation stage, the working ratio of the machines is naturally dropped as well. As a result, an economic problem of difficulty in producing the profit on the weaving processing manufacturer side has been pointed out. Moreover, in the case of producing various kinds in small tots, a large number of problems are involved in that beam dying cannot be executed so as to rely on package dying, and thus the labor in subdivision, warping, or the like is doubled.

SUMMARY OF THE INVENTION

Accordingly, the present invention is a weaving system developed for solving the above-mentioned various problems accompanied by the woven, fabric products of various kinds in small lots, and an object thereof is to provide a weaving system for woven fabrics of various kinds in small lots, capable of weaving woven fabric products of various kinds in small lots in a continuous operation by an existing weaving machine while preventing generation of waste to the minimum degree.

In order to achieve the above-mentioned object, the present invention provides a weaving system for woven fabrics of various kinds in small lots, comprising the steps of successively selecting a plurality of kinds of threads according to a preliminarily-designed design pattern, producing a thread supplying package for the warp by jointing per a predetermined thread supply amount, arranging a plurality of the thread supplying packages for the warp in the weaving width direction for warping a warp beam, and organizing a weft to the warp supplied from the warp beam for forming different design patterns of a plurality of kinds continuously each with a warp thread jointing area disposed, therebetween in the weaving direction.

Furthermore, the present invention also provides the weaving system for woven fabrics of various kinds in small lots, wherein the thread joints of the warp are disposed at positions with phase displacement in she warp longitudinal direction in the thread jointing areas at the time of warping the warp beam.

Furthermore, the present invention provides the weaving system for woven fabrics of various kinds in small lots, wherein a preliminarily designed plurality of kinds of woven fabrics are provided in small lots after weaving, with the thread jointing areas cut off.

BRIEF DESCRIPTION OF THE DRAWINGS

FIG. 5A is a schematic plan view showing an example of a woven fabric product produced by the weaving system.

FIG. 5B is a schematic plan view showing the state of the thread jointing parts of the warps disposed with the random phase displacement in the warp longitudinal direction in a thread jointing area.

FIGS. 6 to 8 are charts for comparing the conventional weaving system and the weaving system for woven fabrics of various kinds in small lots according to the present invention.

FIG. 6 is a chart showing the difference of the effects in the warping and sizing step in the case of a package dying.

FIG. 7 is a chart showing the difference of the effects in the warping and sizing step in the case of a beam dying.

FIG. 8 is a chart showing the difference of the effects in the weaving step.

DESCRIPTION OF THE PREFERRED EMBODIMENTS

Figure 1:
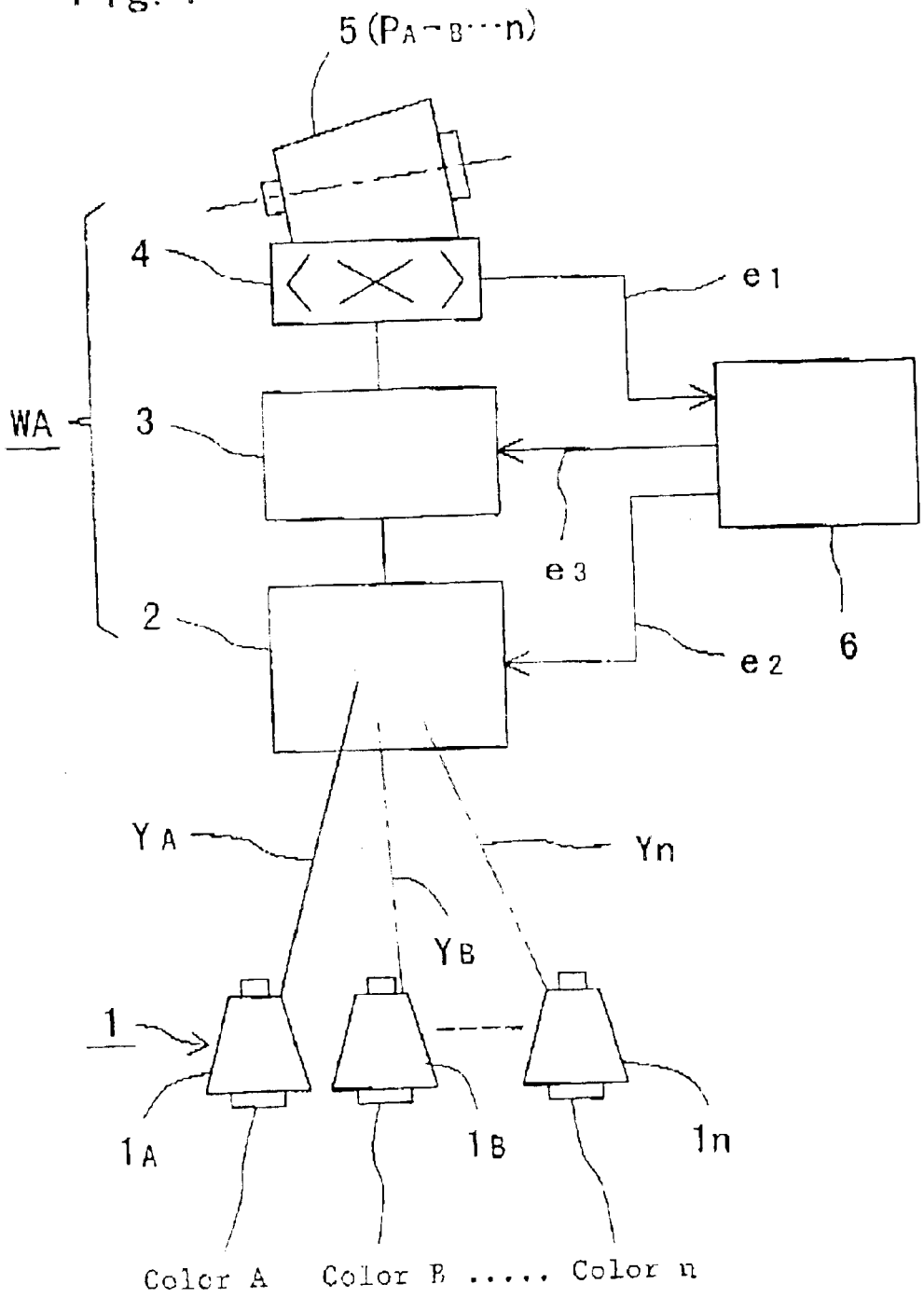
FIG. 1 is a schematic side view of a specific embodiment of a weaving system for woven fabrics of various kinds in small lots according to the present invention, in the stage of forming a thread supplying package for the warp PA-B . . . n by successively jointing color thread groups of n kinds comprising a color thread YA of a color A, a color thread YB of a color B and a color thread Yn of a color n according to a preliminarily designed design pattern.

Hereinafter, the weaving systems for woven fabrics of various kinds in small lots according to the present invention will be explained in detail with reference to specific embodiments shown in the drawings.

First, with reference to FIGS. 1 to 5, details of the weaving systems for woven fabrics of various kinds in small lots according to the present invention will be explained. In the present invention, first, n kinds of a color thread group 1 (1A, 1B, 1*n*) comprising a color thread YA of a color A, a color thread YB of a color B and a color thread Yn of a color n is prepared. Out of the color thread group 1, the color thread YA, the color thread YB and the color thread Yn are selected by a selection unit 2 for realizing a preliminarily designed design pattern so as to be jointed successively by a predetermined length and a predetermined order according to the preliminarily designed design pattern by a thread jointing unit 3 and provided as a warp thread supplying package 5 by a winder apparatus WA including at traverse drum 4.

In the specific embodiment shown in FIG. 1, the above-mentioned winder apparatus WA comprises a control unit 6 for detecting for example, the rotational frequency of the above-mentioned traverse drum 4 (from the rotational frequency, the thread winding length can be calculated). By inputting the detection signal e1 as a feed back signal, selecting the color thread according to a signal e2 corresponding to the above-mentioned selection unit 2 and a signal e3 corresponding to the thread jointing unit 3, and controlling the winding length of the selected color thread, the warp thread supplying package 5 with the color threads for realizing the preliminarily designed design pattern, that is, a warp thread supplying package PA-B . . . n is formed.

On the other hand, although it is not shown in the figures, for example in the case of weaving a color patterned woven fabric including a white ground part as shown in FIG. 5A (in the description of the embodiments hereafter, the weaving operation for a color patterned woven fabrics including the white ground part as shown in FIG. 5A will be explained), a white thread Y0 is prepared by the winder apparatus WA additionally as a white warp thread supplying package P0.

Figure 2:
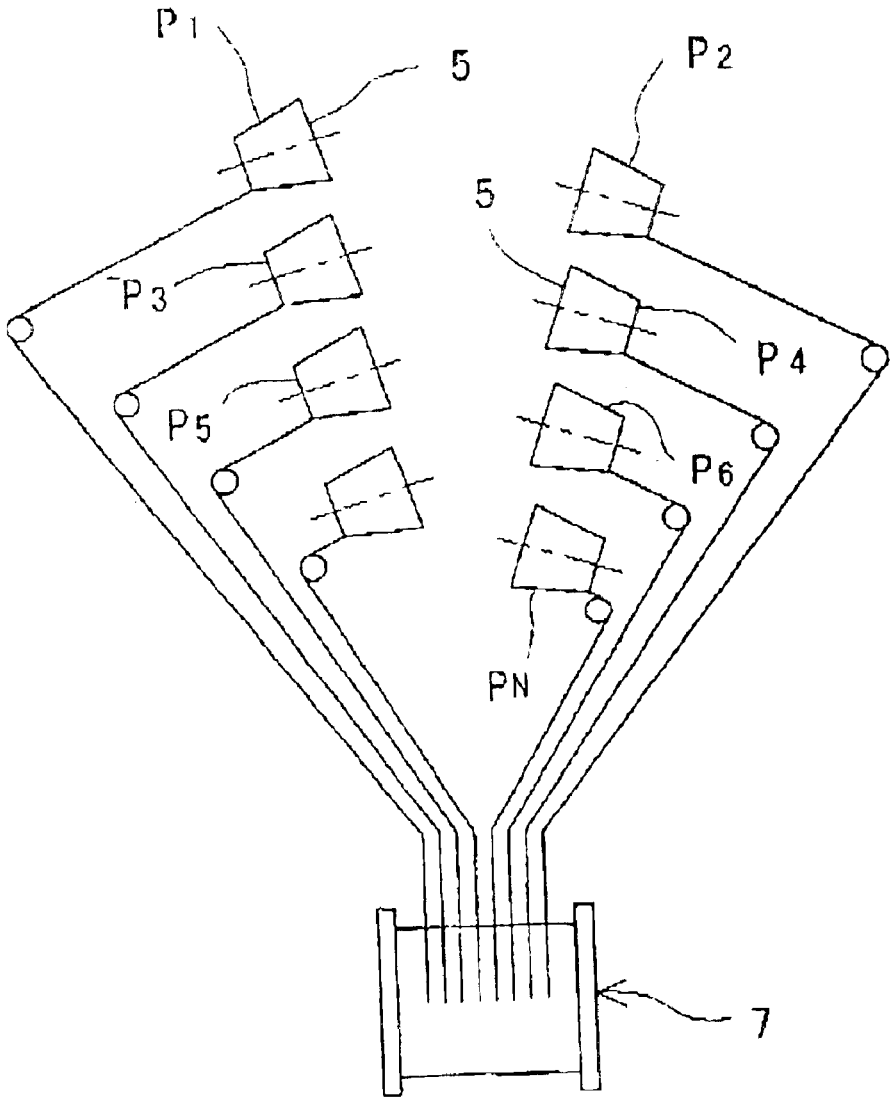
FIG. 2 is schematic side view of a specific embodiment of a weaving system for woven fabrics of various kinds in small lots according to the present invention, in the stage of warping a warp beam by arranging the above-mentioned thread supplying packages of a plurality of the number corresponding to the number of warps in 1 beam in the weaving width direction.
Figure 3:
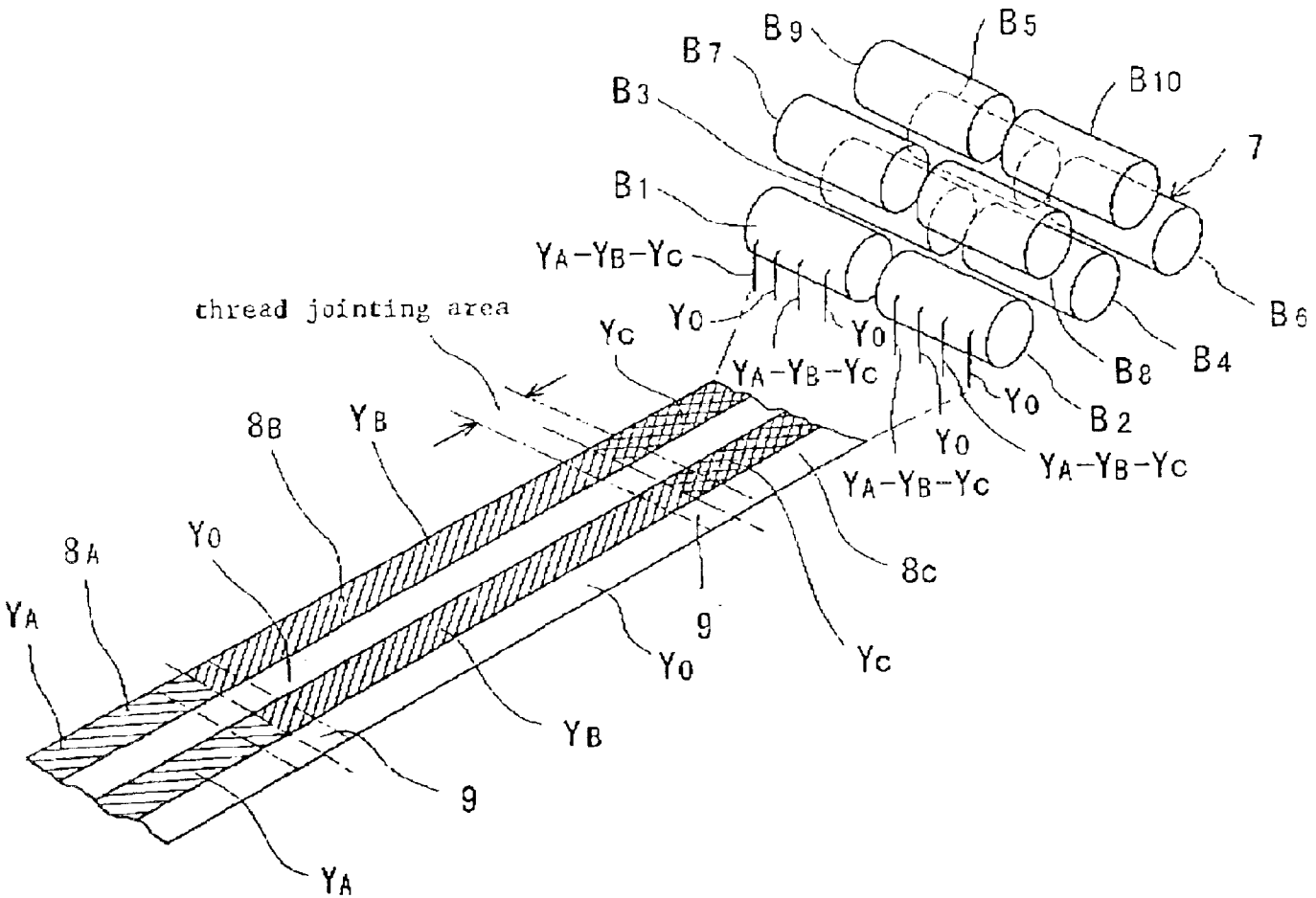
FIG. 3 is a schematic perspective view showing the state of the weaving process with the above-mentioned warp beam in a specific embodiment as a weaving state with 10 sets of warp beams.
Figure 5:
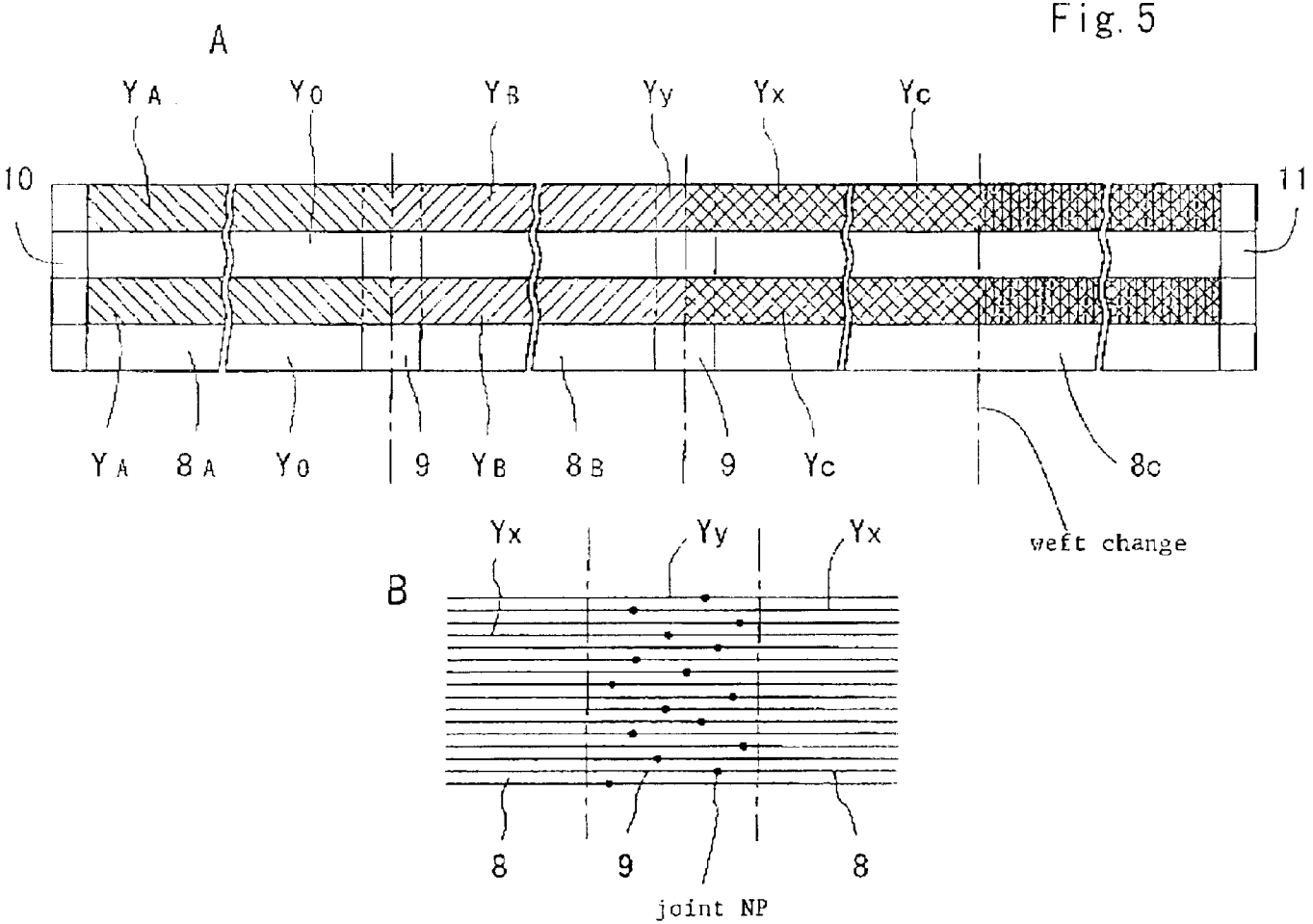
FIG. 5 shows the weaving process state with the above-mentioned warp beams.

For example, in the case of weaving three kinds of color patterned woven fabrics (according to the embodiment shown in FIG. 5A, color patterned woven fabrics of three kinds plus one kind, total four kinds are produced according to the weft change), by the warping unit shown in FIG. 2, for example, the warp thread supplying packages 5 are prepared by a number corresponding to the number of the warps for 1 beam=500 threads as warp thread supplying packages P1 to P500. In the case of weaving the three kinds of the color patterned woven fabrics including the white ground part as shown in FIG. 5, out of the above-mentioned warp thread supplying packages P1 to P500, 250 pieces of the warp thread supplying packages with color thread jointed PA-B-C are prepared, and 250 pieces of the white warp thread supplying packages P0 of the white thread Y0 are prepared so as to have the warping process of the beam 7 by the warping unit shown in FIG. 2. The winding width w of the beam 7 is equal to the weaving width W of the color patterned woven fabric to be produced.

Figure 4:
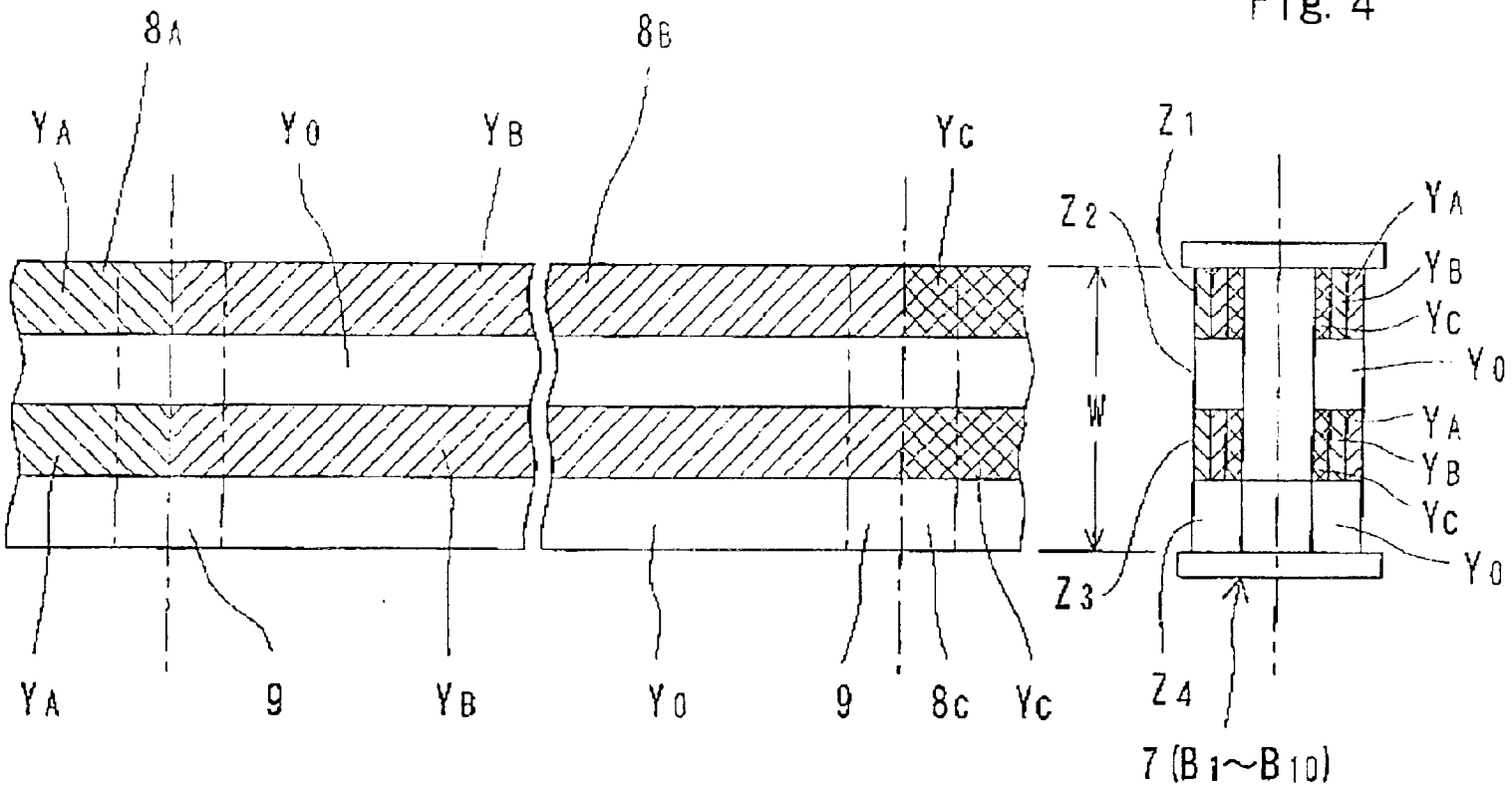
FIG. 4 is a schematic partial plan view of the weaving state of FIG. 3 viewed as a plane, with a warp beam shown in a cross-section.

A warped beam 7 with the warping process applied as mentioned above for example has a color patterned warp YA-YB-YC with the color thread YA, the color thread YB and the color thread YC successively jointed by a desired length wound up in a first area Z1 and a third area Z3, and the white thread Y0 wound up in a second area Z2 and a fourth area Z4 as shown in FIG. 4. by the cross section.

In the case of producing for example a color patterned woven fabric with 5,000 threads of warps by the above-mentioned warping beam 7, 10 pieces of the above-mentioned warping beams 7 (1 beam=500 threads) are prepared as the warped beams B1 to B10. That is, according to the above-mentioned embodiment, the number of warps of the woven fabric to be produced is introduced by a density of 10 times in the weaving width direction with respect to 1 beam. By organizing the weft (not shown) for the color patterned warp YA-YB-YC and the white warp Y0, the three kinds of the color patterned woven fabrics as shown in FIG. 5A can be produced. According to the embodiment shown in FIG. 5A, by changing the weft, woven fabrics with further different patterns can be produced.

In the present invention, the next important point is that an abandoned thread part Yy (of about 3 to 4 m) for the thread jointing area 9 is produced before and after the thread part Yx for the pattern forming area 8 of a length corresponding to the preliminarily designed design pattern and that the abovementioned thread joints NP are disposed intentionally randomly within the above-mentioned thread jointing areas 9 (see FIG. 5B).

The configuration is provided because the thread joints NP are larger than the thread in the present situation so that in the case the thread joints NP exist in a row at the time of the beating process by the weaving machine, the load is made larger so as to cut off the threads.

For the packages produced by the above-mentioned steps, the warping process, the sizing process and the weaving process are provided as in the conventional embodiments. According to the present invention, by optionally replacing the wefts, further various patterns can be produced. In the embodiment shown in FIG. 5A, by finally cutting off the both end parts 10, 11 in the weaving direction and the thread joint areas 9, woven fabric products of various kinds including the pattern A, the pattern B, the pattern C and the pattern D can be produced in small lots.

Figure 8:
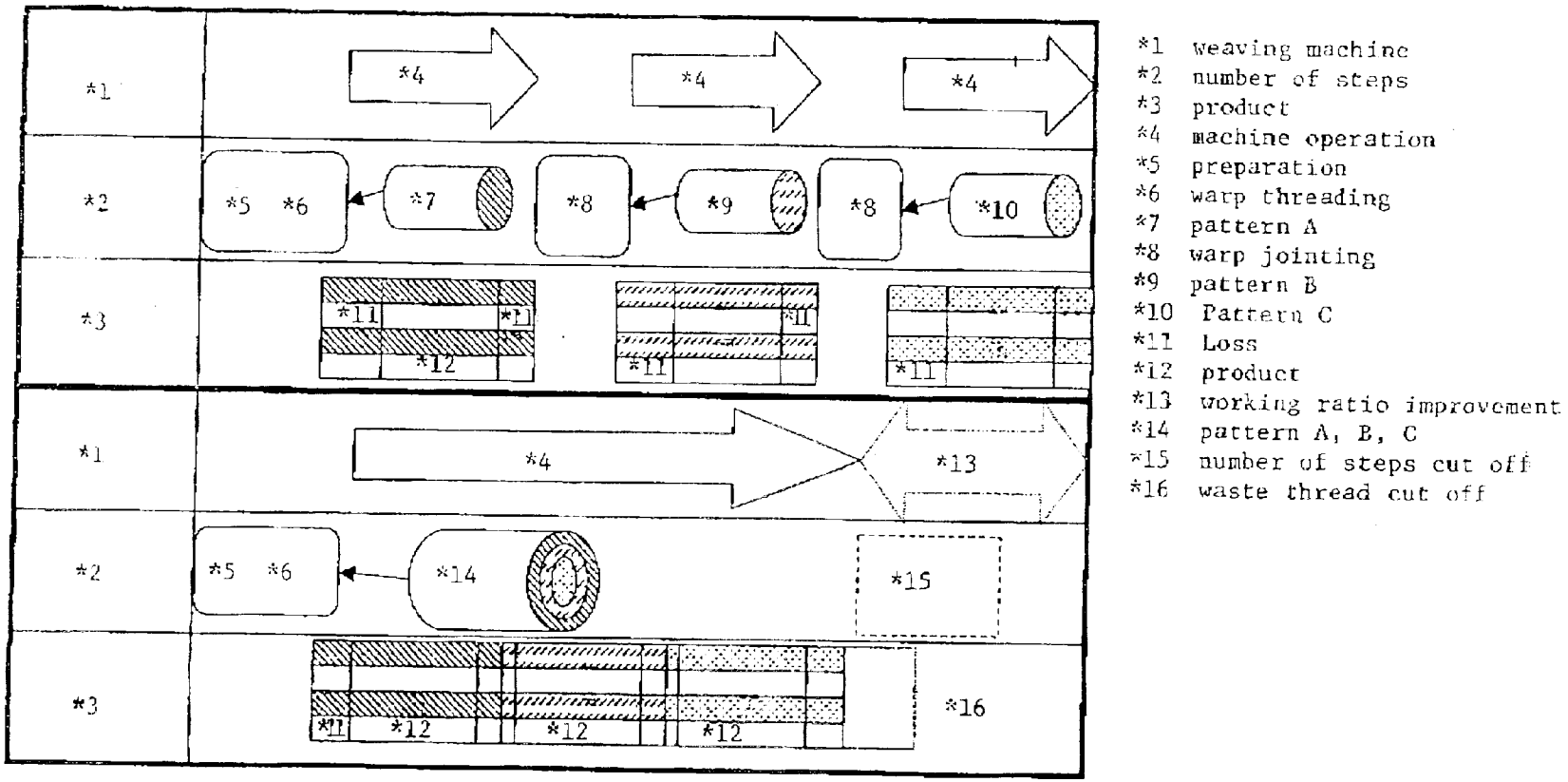

According to the weaving system for woven fabric products of various kinds in small lots of the present invention having the above-mentioned configuration, the effects shown for comparison in FIGS. 6 to 8 can be provided. FIGS. 6 to 8 are for comparing and discussing the difference of the effects between the embodiments of the steps of the weaving system for the woven fabric products of various kinds ill small lots according to the present invention and those of the conventional weaving system. FIG. 6 shows the difference of the effects in the warping and sizing step in the case of a package dying. The specific embodiment shown in the chart is for producing 500 threads/1 beam, and producing 5,000 threads of warps at the sizing step by getting together 10 beams for producing three kinds of patterns with each one of a color thread YA, a color thread YB and a color thread YC introduced to a white color thread Y0. As it is apparent from the chart, in this stage, the machine efficiency is improved in both of the warping step and the sizing step, the number of steps are cult off in the both steps, and the boiler energy is cut off in the starching vessel according to the present invention.

FIG. 7 is a chart showing the difference of the effects in the warping step and the sizing step in the case of a beam dying. Similar to the above-mentioned, the specific embodiment shown in the chart is for producing 500 threads/1 beam, and producing 5,000 threads of warps at the sizing step by getting together 10 beams for producing three kinds of patterns with each one of a color thread YA, a color thread YB and a color thread YC introduced to a white color thread Y0. As it is apparent from the chart, in this stage, the machine efficiency is improved in both of the warping step and the sizing step, the number of steps is cut off in the both step, and the boiler energy is cut off in the starching vessel, and the number of the beams are reduced according to the present invention.

FIG. 8 is a chart showing the difference of the effects in the weaving step. According to the chart, the weaving machine operation states at the time of producing a product requiring the warp change of three kinds are compared. As it is apparent from the chart, in the weaving step stage, since the warps are already linked and arranged in the order according to the present invention, the weaving machine can be driven continuously so that the machine working ratio can be improved. Furthermore, since the thread jointing operation is not required in the operation periods, the steps can be cut off and the loss part of the products can also be reduced,

What is claimed is:

1. A weaving system for woven fabrics of various kinds in small lots, comprising the steps of successively selecting a plurality of kinds of threads according to a preliminarily designed design pattern, producing a plurality of thread supplying packages for a warp by jointing per a predetermined thread supply amount, warping a warp beam from the plurality of the thread supplying packages for the warp, and organizing a weft to the warp supplied from the warp beam for forming different design patterns of a plurality of kinds in the weaving direction continuously.

2. A weaving system for woven fabrics of various kinds in small lots, comprising the steps of successively selecting a plurality of kinds of threads according to a preliminarily designed design pattern, producing a plurality of thread supplying packages for a warp by jointing per a predetermined thread supply amount, and warping a warp bcc-am corresponding to the weaving width out of the plurality of the thread supplying packages for the warp, and continuously forming different design patterns of a plurality of kinds directly from the warp beam.

3. A weaving system for woven fabrics of various kinds in small lots, comprising the steps of successively selecting a plurality of kinds of threads according to a preliminarily designed design pattern, producing a plurality of thread supplying packages for a warp by jointing per a predetermined thread supply amount, warping small wound beams from the plurality of the thread supplying packages for the warp, and further forming a large wound beam from a plurality of the small wound beam, and forming different design patterns of a plurality of kinds continuously from the large wound beam.

4. The weaving system for woven fabrics of various kinds in small lots according to any one of claims 1 to 3, wherein the thread joints of the warp are disposed at positions with phase displacement in the warp longitudinal direction at the time of warping the warp beam.

5. The weaving system for woven fabrics of various kinds in small lots according to claim 4, wherein a preliminarily designed plurality of kinds of woven fabrics are provided in small lots after weaving, with the area including the thread joints cut off.

* * * * *